US008408438B2

(12) United States Patent
Taylor

(10) Patent No.: US 8,408,438 B2
(45) Date of Patent: Apr. 2, 2013

(54) EASY GRIP TOOL-FREE DEPTH-OF-DRIVE ADJUSTMENT

(75) Inventor: Walter J. Taylor, McHenry, IL (US)

(73) Assignee: Illinois Tool Works Inc., Glenview, IL (US)

( * ) Notice: Subject to any disclaimer, the term of this patent is extended or adjusted under 35 U.S.C. 154(b) by 196 days.

(21) Appl. No.: 13/030,608

(22) Filed: Feb. 18, 2011

(65) Prior Publication Data

US 2012/0211541 A1 Aug. 23, 2012

(51) Int. Cl.
*B25C 1/18* (2006.01)

(52) U.S. Cl. ..... 227/142; 227/8

(58) Field of Classification Search ..... 227/142, 227/140, 9, 10, 120, 130; 24/591.1, 594.11, 24/594.1, 697.1, 700, DIG. 43, DIG. 46
See application file for complete search history.

(56) References Cited

U.S. PATENT DOCUMENTS

| | | | | |
|---|---|---|---|---|
| 4,404,722 | A | 9/1983 | Shimai | |
| 4,483,473 | A | 11/1984 | Wagdy | |
| 4,483,474 | A | 11/1984 | Nikolich | |
| 4,552,162 | A | 11/1985 | Finger | |
| RE32,452 | E | 7/1987 | Nikolich | |
| 5,197,646 | A | 3/1993 | Nikolich | |
| 5,263,439 | A | 11/1993 | Doherty et al. | |
| 5,263,842 | A * | 11/1993 | Fealey | 227/8 |
| 5,558,264 | A | 9/1996 | Weinstein | |
| 5,678,899 | A | 10/1997 | Lewis, Jr. | |
| 6,209,770 | B1 * | 4/2001 | Perra | 227/8 |
| 6,705,501 | B2 * | 3/2004 | Miller et al. | 227/8 |
| 6,851,595 | B1 | 2/2005 | Lee | |
| 6,959,850 | B2 * | 11/2005 | Taylor et al. | 227/8 |
| 6,988,648 | B2 * | 1/2006 | Taylor et al. | 227/142 |
| 6,997,365 | B2 * | 2/2006 | Miller et al. | 227/8 |
| 7,055,729 | B2 * | 6/2006 | Taylor et al. | 227/142 |
| 7,748,586 | B2 * | 7/2010 | Akiba | 227/10 |
| 7,757,920 | B2 * | 7/2010 | Shea et al. | 227/8 |
| 2002/0121540 | A1 * | 9/2002 | Taylor et al. | 227/142 |
| 2005/0189390 | A1 * | 9/2005 | Taylor et al. | 227/8 |
| 2006/0065692 | A1 * | 3/2006 | Taylor et al. | 227/142 |
| 2008/0121676 | A1 * | 5/2008 | Akiba | 227/7 |

* cited by examiner

*Primary Examiner* — M. Alexandra Elve
*Assistant Examiner* — Andrew M Tecco
(74) *Attorney, Agent, or Firm* — Greer, Burns & Crain, Ltd.; Patty Chidiac; Mark W. Croll

(57) ABSTRACT

An adjustable depth-of-drive assembly for use with a fastener-driving tool upper probe includes a workpiece contact element carried on the upper probe and having a contact end and an adjustment end, a stop configured for being secured to the upper probe and being moveable between an adjusting position in which the workpiece contact element is movable relative to the upper probe, and a locked position wherein the adjustment end is secured against movement relative to the upper probe, a biasing element associated with the stop and configured for urging the stop and the adjustment end into a selected locked position relative to the upper probe with a biasing force, and at least one camming element carried on the stop for selective camming engagement between the upper probe and the stop by means of a user's manual force to urge the stop into the adjusting position against the biasing element force.

19 Claims, 4 Drawing Sheets

EASY GRIP TOOL-FREE DEPTH-OF-DRIVE ADJUSTMENT

BACKGROUND OF THE INVENTION

The present invention relates generally to fastener-driving tools used to drive fasteners into workpieces, and specifically to combustion-powered fastener-driving tools, also referred to as combustion tools. More particularly, the present invention relates to improvements in a device or assembly that adjusts the depth-of-drive of the tool.

As exemplified in Nikolich, U.S. Pat. Re. No. 32,452, and U.S. Pat. Nos. 4,552,162; 4,483,473; 4,483,474; 4,404,722; 5,197,646; 5,263,439; 5,558,264, 5,678,899, 6,959,850, 6,988,648 and 7,055,729, all of which are incorporated by reference, fastening tools, and particularly, portable combustion-powered tools for use in driving fasteners into workpieces are described. Such fastener-driving tools are available commercially from ITW-Paslode (a division of Illinois Tool Works, Inc.) of Vernon Hills, Ill., under the IMPULSE® and PASLODE® brands.

Such tools incorporate a tool housing enclosing a small internal combustion engine. The engine is powered by a canister of pressurized fuel gas, also known as a fuel cell. A battery-powered electronic power distribution unit produces the spark for ignition, and a fan located in the combustion chamber provides for an efficient combustion within the chamber, and facilitates scavenging, including the exhaust of combustion by-products. The engine includes a reciprocating piston having an elongate, rigid driver blade disposed within a piston chamber of a cylinder body.

The wall of a combustion chamber is axially reciprocable about a valve sleeve and, through a linkage, moves to close the combustion chamber when a workpiece contact element at the end of a nosepiece connected to the linkage is pressed against a workpiece. This pressing action also triggers a fuel-metering valve to introduce a specified volume of fuel gas into the closed combustion chamber from the fuel cell.

Upon the pulling of a trigger, a charge of gas in the combustion chamber of the engine is ignited, causing the piston and driver blade to be shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston returns to its original, or "ready" position through differential gas pressures within the cylinder. Fasteners are fed into the nosepiece from a supply assembly, such as a magazine, where they are held in a properly positioned orientation for receiving the impact of the driver blade. The power of these tools differs according to the length of the piston stroke, volume of the combustion chamber, fuel dosage and similar factors.

Combustion-powered tools have been successfully applied to large workpieces requiring large fasteners, such as for framing, roofing and other heavy-duty applications. Smaller workpiece and smaller fastener trim applications demand a different set of operational characteristics than the above-identified heavy-duty applications. Other types of fastener-driving tools such as pneumatic, powder activated and/or electrically powered tools are well known in the art, and are also contemplated for use with the present depth-of-drive adjustment assembly.

One operational characteristic required in fastener-driving applications, particularly in trim applications, is the ability to predictably control fastener-driving depth. For the sake of appearance, some trim applications require fasteners to be countersunk below the surface of the workpiece, others require the fasteners to be sunk flush with the surface of the workpiece, and some may require the fasteners to stand off above the surface of the workpiece. Depth adjustment has been achieved in pneumatically powered and combustion powered tools through a tool controlling mechanism, known as a drive probe, which is movable in relation to the nosepiece of the tool. Its range of movement defines a range for fastener depth-of-drive. Similar depth-of-drive adjustment mechanisms are known for use in combustion-type framing tools.

A conventional arrangement for depth adjustment involves the use of respective overlapping plates or tongues of a workpiece contact element and an upper probe or wire form. At least one of the plates is slotted for sliding relative to length adjustment. Threaded fasteners such as cap screws are employed to releasably secure the relative position of the plates together. The depth-of-drive is adjusted by changing the length of the workpiece contact element relative to the upper probe. Once the desired depth is achieved, the fasteners are tightened.

It has been found that users of such tools are inconvenienced by the requirement for an Allen wrench, nut driver, screwdriver or comparable tool for loosening the fasteners, and then retightening them after length adjustment has been completed. In operation, it has been found that the extreme shock forces generated during fastener-driving cause the desired and selected length adjustment to loosen and vary. Thus, the fasteners must be monitored for tightness during tool use.

To address the problem of maintaining adjustment, grooves or checkering have been added to the opposing faces of the overlapping plates to increase adhesion when the fasteners are tightened. However, to maintain the strength of the components in the stressful environment of fastener driving, the grooves must be made deep enough to provide the desired amount of adhesion. Deeper grooves could be achieved without weakening the components by making the plates thicker, but that would add weight to the linkage, which is undesirable.

Other attempts have been made to provide tool-free depth-of-drive adjustment, but they have also employed the above-described opposing face grooves for additional adhesion, which is still prone to the adhesion problems discussed above.

Another design factor of such depth adjustment or depth-of-drive (used interchangeably) mechanisms is that the workpiece contact elements are often replaced over the life of the tool. As such, the depth adjustment mechanism preferably accommodates such replacement while retaining compatibility with the upper probe of the tool, which is not necessarily replaced.

In U.S. Pat. No. 7,055,729, an adjustable depth-of-drive assembly for use with a fastener-driving tool is provided and includes a workpiece contact element having a contact end and an adjustment end, at least one stop configured for being secured to the tool and being normally moveable between an adjusting position in which the workpiece contact element is movable relative to the tool, and a locked position where the adjustment end is secured from movement relative to the tool, and at least one biasing element associated with the stop and configured for urging the stop and the adjustment end into a selected locked position relative to the tool without the use of tools.

However, with this previous tool-free depth-of-drive adjustment assembly, the user is required to lift the stop, by the ears, with one hand, and continue to hold it lifted with that hand while pulling the tool down against the lifting force, while moving the stop in a perpendicular direction. This results in a tiring and somewhat cumbersome operation.

Accordingly, there is a need for an improved fastener-driving tool depth-of-drive adjustment assembly where the adjustment is secured without the use of tools and is maintained during extended periods of fastener driving. There is also a need for an improved fastener depth adjustment assembly which provides for ease of movement of the stop from the locked to the adjusting position without requiring the user to pull in two opposite directions at the same time, and to pull for extended lengths of time. Finally, there is a need for an improved fastener depth-of-drive assembly which can be replaced when the life of the workpiece contact element has expired without requiring the replacement of the entire fastener-driving tool.

SUMMARY OF THE INVENTION

The above-listed needs are met or exceeded by the present tool-free depth-of-drive adjustment assembly for a fastener-driving tool. Among other things, the present assembly is designed to allow the user to easily, and with a low energy expenditure output, by means of an easy gripping force, move the stop from the locked position to the adjusting position, and to hold it there while the position of the stop relative to the workpiece contact element is changed, while at the same time allowing for adjustment by the user without the use of tools. Release of the stop by the user returns the stop to the locked position.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DETAILED DESCRIPTION OF THE PREFERRED EMBODIMENTS

Figure 1:
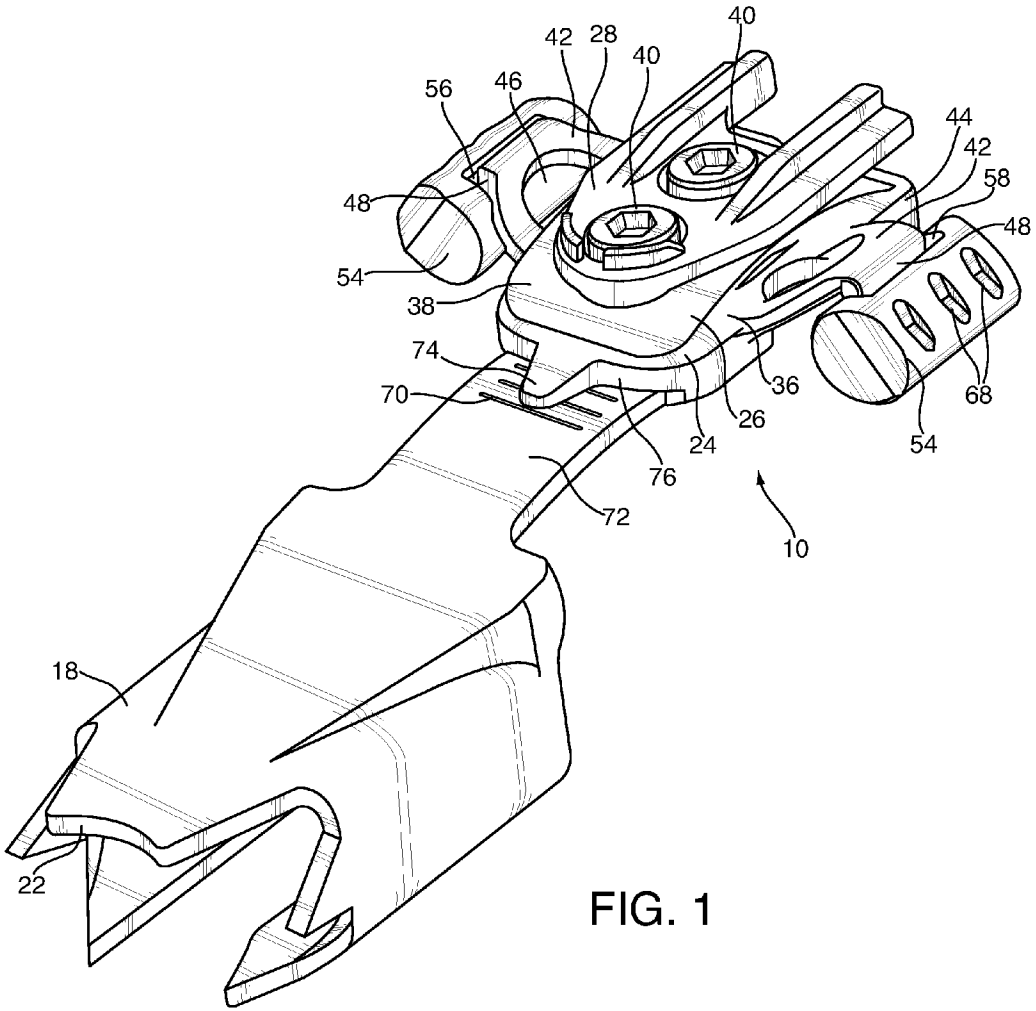
FIG. 1 is a top perspective view of a depth-of-drive adjustment assembly shown in the locked position.
Figure 2:
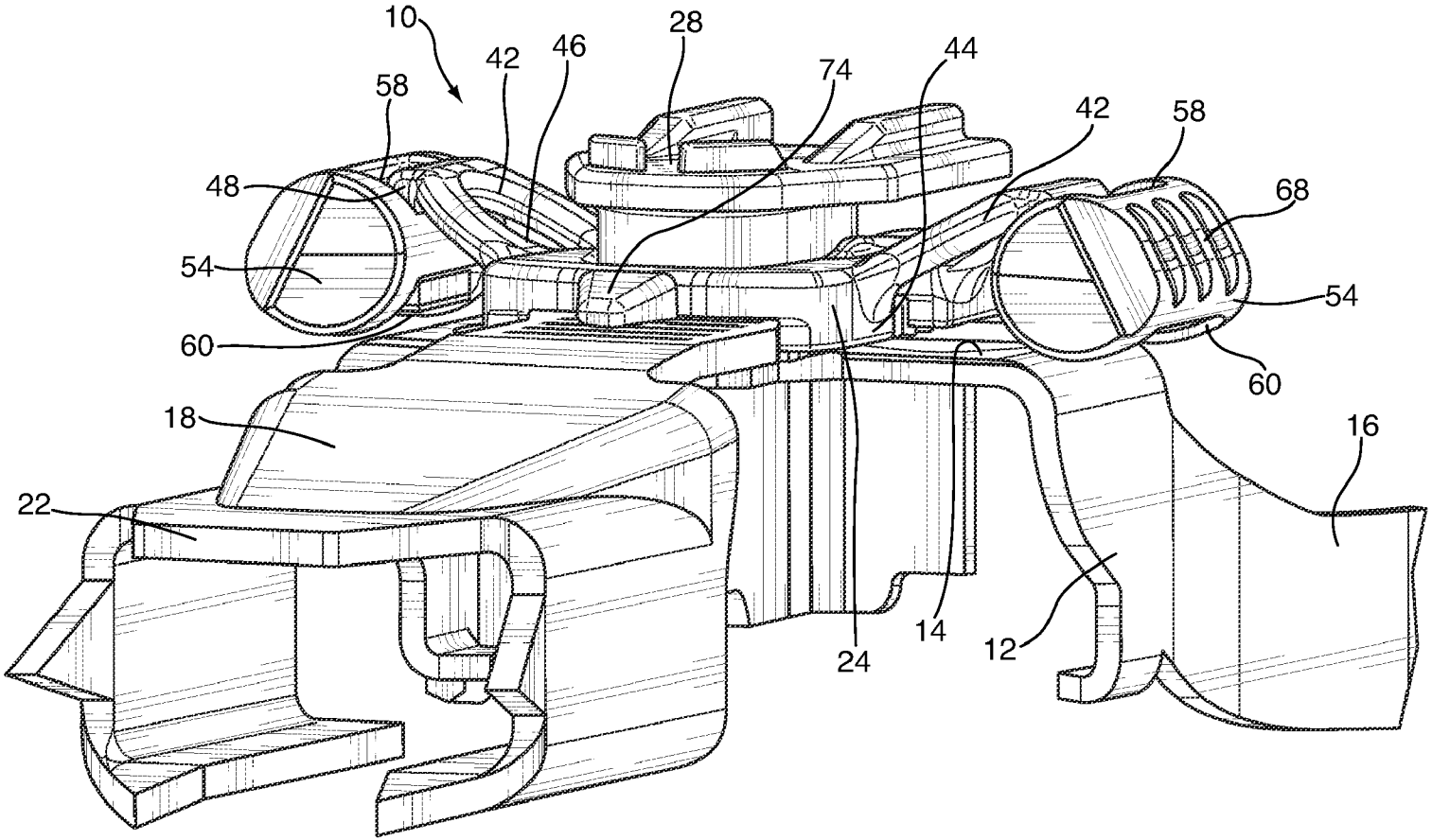
FIG. 2 is a front perspective view of components of the depth-of-drive adjustment assembly of FIG. 1 in the locked position.

Referring now to FIG. 1, an improved adjustable depth-of-drive assembly is generally designated 10, and is intended for use on a fastener-driving tool of the type described in U.S. Pat. No. 7,055,729, incorporated herein by reference. An upper probe 12 (FIGS. 2 and 3) is to be attached to the tool, and has a generally horizontal platform 14 (in the position of the assembly as shown in FIG. 2) and a pair of elongate arms 16 (partially shown) which are connected at free ends to the tool as is known in the art. In the preferred embodiment, the upper probe 12 is fabricated by being stamped and formed from a single piece of metal, however other rigid durable materials and fabrication techniques are contemplated.

The tool further includes a nosepiece (not shown) that is fixed relative to the tool. The nosepiece is configured for receiving fasteners from a magazine (not shown), as is known in the art. A workpiece contact element 18 is configured for reciprocal sliding movement relative to the nosepiece, and preferably surrounds the nosepiece on at least three sides.

The present depth-of-drive assembly 10 is configured for adjusting the relative position of the workpiece contact element 18 to the upper probe 12, which in turn alters the relative position of the workpiece contact element to the nosepiece and the tool. Generally, as the nosepiece is brought closer to a workpiece surface, fasteners driven by the tool are driven deeper into the workpiece.

The workpiece contact element 18 includes a tongue portion or an adjustment end 20 (best seen in FIG. 3) and a contact end 22 opposite the adjustment end 20. The contact end 22 extends past the nosepiece, and as is known in the art, contacts the workpiece surface into which the fastener is to be driven. While stamping a single piece of metal is a preferred construction for the workpiece contact element 18, other methods of fabrication are contemplated as are known in the art.

The present depth-of-drive assembly 10 is configured for being fastened to the platform 14 of the upper probe 12 of the fastener-driving tool and further includes a stop 24 that is configured for being removably engaged with the workpiece contact element 18. A biasing element 26 is configured for exerting a biasing force against the stop 24, urging the stop in a direction which is normal (perpendicular) relative to the movement of the workpiece contact element 18 and into engagement with the workpiece contact element. The biasing element 26 is removed in FIGS. 2 and 3 for clarity, but normally is present. A spacer 28 is constructed and arranged for compressing the biasing element 26 against the stop 24.

In the present depth-of-drive assembly 10, the adjustment end 20 of the workpiece contact element 18 has at least one toothed edge 30 (FIG. 3), and the stop 24 has at least one corresponding toothed surface 32 (FIGS. 3 and 4) with teeth configured for positively engaging teeth of the toothed edge 30 in one of a plurality of selected adjustment positions. Preferably, the stop 24 has a depending skirt 34, and the at least one toothed surface 32 is disposed on the skirt. Furthermore, in the preferred embodiment, the adjustment end 20 of the workpiece contact element 18 includes two, generally parallel toothed edges 30, and a corresponding one of the at least one toothed surfaces 32 on the skirt 34 is configured to engage each of the toothed edges on the workpiece contact element 18.

The biasing element 26 (FIG. 1) is preferably convex in shape, and is configured to keep tension on the stop 24. It is contemplated that the convex biasing element 26 provides a stronger or more robust linkage between the upper probe 12 and the nosepiece, thereby maintaining the desired depth of adjustment of the tool during operation. It is further contemplated that the biasing element 26 is formed out of a single piece of metal by stamping, but other methods of fabrication are contemplated as is known in the art.

The biasing element 26 is disposed between the spacer 28 and a top surface 36 of the stop 24. While other types of springs are contemplated, the biasing element is a relatively flat piece of spring steel with an arched or preloaded side profile. A convex surface 38 is preferably disposed adjacent the spacer 28. The biasing element 26 provides sufficient biasing force to urge the stop 24 against the adjustment end 20 of the work contact element 18 so that the corresponding teeth 30, 32 are tightly meshed together.

The present assembly 10 further includes at least one and preferably a pair of fasteners 40 (FIG. 1) configured for being inserted into a pair of through-bores in the spacer 28. The upper probe platform 14 includes at least one and preferably a pair of platform openings that are configured to register with the spacer bores. The fasteners 40 are configured for fastening the present depth-of-drive assembly 10 to the upper probe platform 20 of the fastener-driving tool. After the fasteners 40 are inserted through both the spacer bores and the platform openings of the upper probe 12, the fasteners threadably engage and are tightened into a nut block, as is shown in U.S. Pat. No. 7,055,729. Upon tightening of the fasteners 40 into the nut block, the present assembly 10 is securely fastened to the tool.

Once the fasteners 40 are tightened into the nut block, a lower undercut 41 (FIG. 3) on the spacer 28 defines a height which generally corresponds to the thickness of the adjustment end 20. While the stop 24 is prevented from movement along the front-to-back axis of the workpiece contact element 18, the adjustment end 20 and with it the workpiece contact element, is axially slidable relative to the fastened spacer 28, as well as the biasing element 26 and the stop 24.

In the present assembly 10, the stop 24 further includes a pair of outwardly extending ears 42 located on a pair of opposite sides 44 of the stop 24. The ears 42 include openings 46 (best seen in FIG. 4) that are configured to allow the operator of the tool access to so-called "quick-clear" screws (not shown) located in the nosepiece and accessible through a pair of quick-clear holes located on the upper probe platform 14. It is contemplated that the ears 42 are dimensioned to facilitate access for cleaning out debris that may form between the stop 24 and the adjustment end 20 of the workpiece contact element 18. It is preferred that the stop 24 be manufactured by means of MIM, which could reduce manufacturing cost by allowing the stop to be manufactured in one single piece of metal. However, other means of fabrication are also contemplated, as are known in the art.

The ears 42 each have a tab 48 extending downwardly at an acute angle from a lateral outside edge of the ears. The tab 48 extends downwardly and terminates at an end 50 which has a forward and rearward protrusion 52. A plastic cylindrical camming element 54 may be received on each tab 48 by means of a passage 56 extending through the camming element. The passage 56 is formed by a top slot-like opening 58 leading to a wider bottom opening 60, such that a laterally inside wall 62 and a laterally outside wall 64 forming the passage are angled relative to one another. End walls 66 also define the passage 56, and the protrusions 52 on the tabs 48 frictionally engage with the end walls 66 to movingly hold the camming elements 54 on the tabs.

The camming elements 54 are preferably formed by a hard plastic material, such as having a durometer value of 95-100. While the camming elements 54 are generally cylindrical in shape, they may be provided with a number of gripping grooves 68 on an outside surface thereof to assist in the manual manipulation and gripping of the camming elements, as described below.

In the present depth-of-drive assembly 10, the ears 42 are also configured for facilitating easy removal of the assembly 10 from the tool. By loosening the fasteners 40 from the nut block, the assembly 10 can be easily removed by pulling upward on the ears 42 or the camming elements 54 carried on the ears, in a direction perpendicular to the motion of the workpiece contact element 18 relative to the upper probe 12 of the tool. This upward motion causes the biasing element 26 to relieve compression on the assembly 10, thereby "unlocking" the assembly 10 from the tool.

When the tool is at rest, the stop 24 is normally biased into the locked position against the workpiece contact element 18 as shown in FIGS. 1 and 2 by the biasing element 26. The camming elements 54 are carried on the tabs 48 and are rolled outwardly to a position such that the laterally inside wall 62 is positioned closest to the tab. In this position, the camming elements 54 are displaced laterally of the platform 14 of the upper probe 12.

Figure 3:
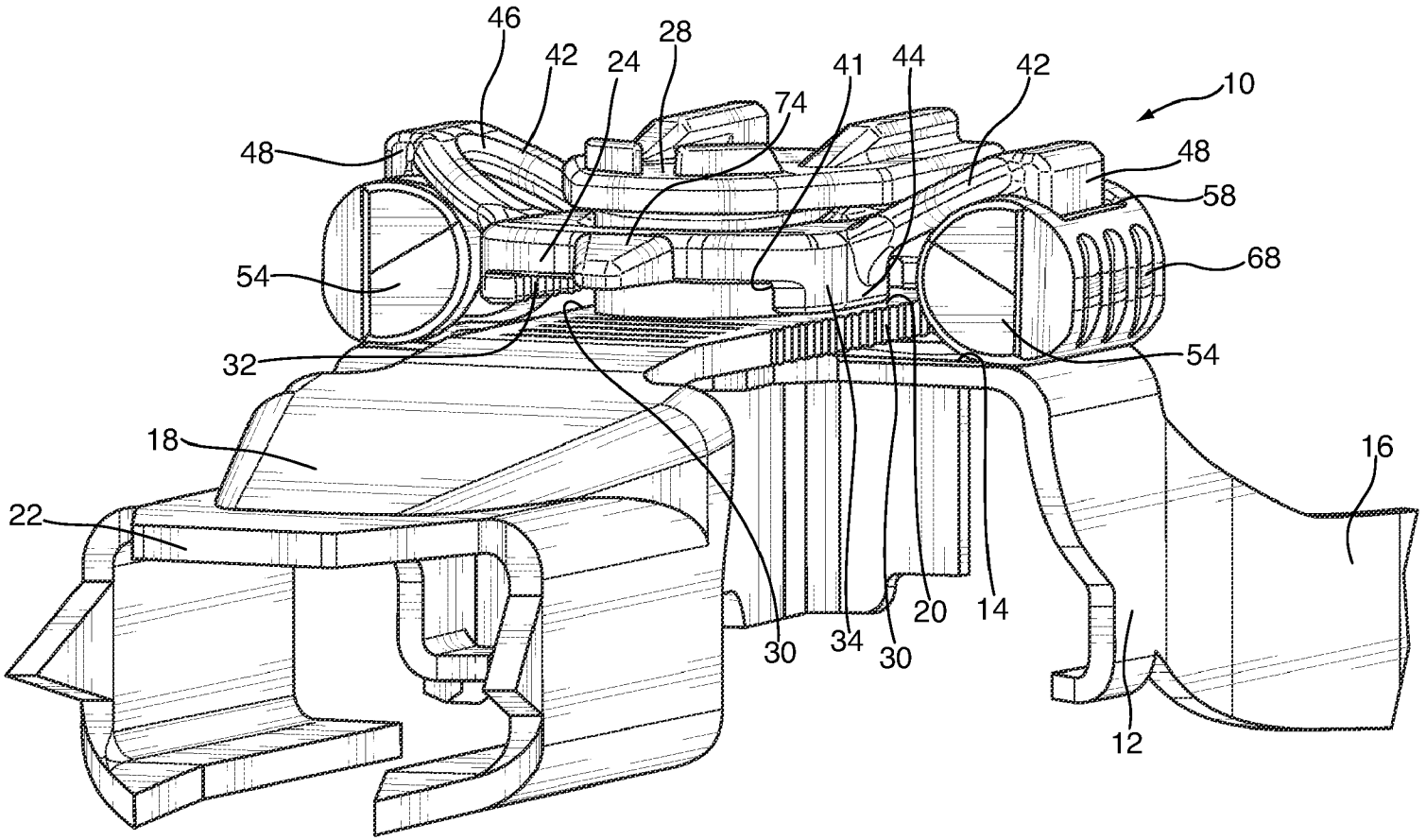
FIG. 3 is a front perspective view of components of the depth-of-drive adjustment assembly of FIG. 1 in the adjustment position.
Figure 4:
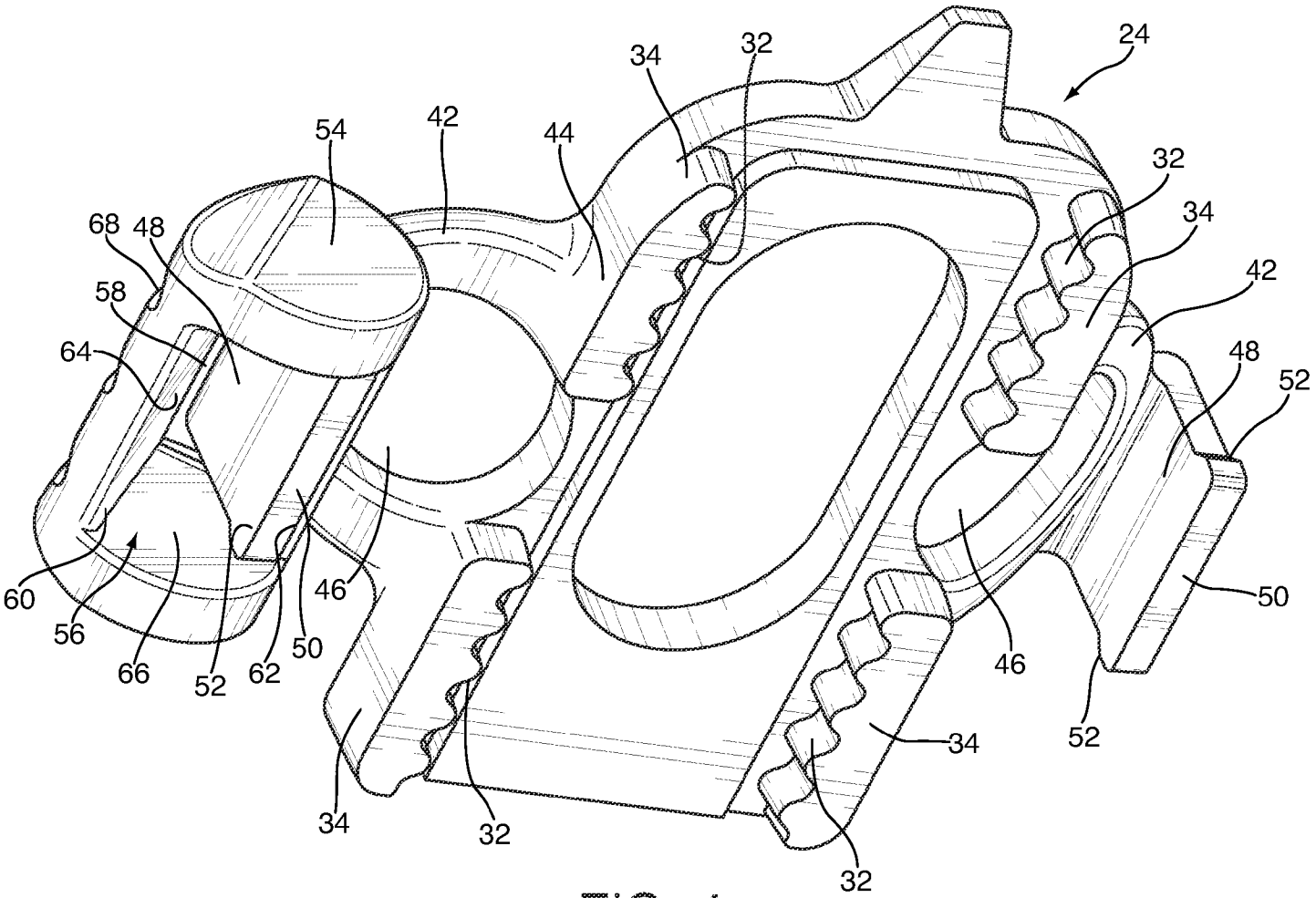
FIG. 4 is a bottom perspective view of the stop and camming element in isolation.

To adjust the assembly 10 relative to the tool, the operator grips one or both of the camming elements 54 and presses one or both camming elements laterally inwardly in a squeezing motion, which causes one or both camming elements to roll against the underside of its associated ear 42 and to engage the platform 14 of the upper probe 12. The squeezing force continues until the laterally outside wall 64 of the passage 56 is moved into close proximity to the tab 48. The gripping grooves 68 assist in providing a non-slip surface for the squeezing action of the user. Continued squeezing by the user will cause the camming element(s) 54 to slide on the generally horizontal surface of the platform 14 and as the camming element rolls, it will press against the underside of the ear 42 associated with its tab 48, pushing the ear (and therefore the stop 24) upwardly against the bias of the biasing element 26 and away from the workpiece contact element 18. With the camming element(s) 54 squeezed inwardly, the stop 24 will remain in the adjustment position, as shown in FIG. 3, wherein the teeth 32 of the stop 24 are disengaged from the teeth 30 of the workpiece contact element 18. This will allow the workpiece contact element 18 to be moved by the user in a direction (forward or backward) perpendicular to the squeezing force on the camming element(s) 54. The user is required to use only one hand to move the stop 24 into the adjustment position, freeing the user's other hand for use in moving the workpiece contact element 18.

When the workpiece contact element 18 has been moved to the correct position, the user simply releases the squeezing force and the biasing element 26 will press the stop 24 back down into locking engagement with the workpiece contact element 18, locking the two sets of teeth 30, 32 together. The camming elements 54 are caused to roll outwardly by sliding along the generally horizontal surface of the platform 14 until they are moved laterally clear of the platform as shown in FIG. 2. The workpiece contact element 18 remains in its new or locked position because of the positive engagement between the teeth 30, 32. Also, the adjustment is accomplished without the use of tools.

To more accurately determine the desired depth-of-drive, the present assembly 10 further includes a depth indicator scale 70 located on a top surface 72 of the workpiece contact element 18. The scale 70 is configured to correspond with a pointer 74 extending outwardly from a front end 76 of the stop 24, which shows the depth-of-drive. There is a direct relationship between the depth indicator scale 70 and the pointer 74 because the workpiece contact element 18 and the stop 20 are connected to each other.

Aside from accompaniment with new tools, it is also contemplated that the present depth-of-drive assembly 10 may be provided as a kit for repairing or retrofitting an existing fastener-driving tool. Because workpiece contact elements tend to need replacement before the remainder of the fastener-driving tool, a kit that allows replacement of the workpiece contact element on its own provides a cost-effective solution to normal tool wear. Such a kit includes a workpiece contact element 18 having an adjustment end 20 and a contact end 22. The kit further includes a stop 24 configured to be removably secured to the workpiece contact element 18, a biasing element 26 configured to be placed on a top side of the stop 24, and a spacer 28. The stop 24 includes the ears 42 and tabs 48 and a camming element 54 is carried on each of the tabs. Finally, the kit optionally includes a pair of fasteners 40 configured for securing the kit to the tool, and a nut block. The kit is installed by removing the existing workpiece contact element 18 and associated depth-of-drive components and replacing them with the assembly 10 as described above.

While a particular embodiment of the present tool-free depth-of-drive assembly for a fastener-driving tool has been described herein, it will be appreciated by those skilled in the art that changes and modifications may be made thereto without departing from the invention in its broader aspects and as set forth in the following claims.

The invention claimed is:

1. An adjustable depth-of-drive assembly for use with an upper probe of a fastener-driving tool, said assembly comprising:

a workpiece contact element carried on said upper probe and having a contact end and an adjustment end;

at least one stop configured for being secured to said upper probe and being moveable between an adjusting position in which said workpiece contact element is movable relative to said upper probe, and a locked position wherein said adjustment end is secured against movement relative to said upper probe;

at least one biasing element associated with said stop and configured for urging said stop and said adjustment end into a selected locked position relative to said upper probe with a biasing force; and at least one camming element carried on said stop for selective camming engagement between said upper probe and said stop by means of a user's manual force to urge said stop into said adjusting position against said force of said biasing element.

2. The assembly of claim 1 wherein said assembly is configured for being fastened to a platform of said upper probe of said fastener-driving tool with said camming element engageable with said platform.

3. The assembly of claim 1 wherein said adjustment end of said workpiece contact element has at least one toothed edge, and said stop has at least one corresponding toothed surface for positively engaging said adjustment end teeth in one of a plurality of selected adjustment positions.

4. The assembly of claim 3 wherein said stop has a depending skirt and said at least one toothed surface is disposed on said skirt.

5. The assembly of claim 4 wherein two generally parallel side edges of said adjustment end are toothed, and said skirt is provided with teeth for engaging both of said edges.

6. The assembly of claim 1 further comprising at least one ear located on said stop, and extended outwardly from said stop and wherein said camming element comprises a cylindrical element with a passage therethrough sized to receive a tab depending from said ear of said stop.

7. The assembly of claim 6 further including a pair of opposed protrusions formed on said tab to frictionally engage opposite end walls of said passage.

8. The assembly of claim 6 wherein said passage has a narrow top opening and a wide bottom opening such that said tab is received in said narrow top opening and said cylindrical element is able to roll relative to said ear.

9. The assembly of claim 1 further comprising two ears located on said stop extending outwardly away from each other and wherein said at least one camming element comprises two cylindrical elements, each with a passage therethrough sized to receive a tab depending from one of said ears of said stop.

10. The assembly of claim 9 further including a pair of opposed protrusions formed on each tab to frictionally engage opposite end walls of one of said passages.

11. The assembly of claim 9 wherein said passages each have a narrow top opening and a wide bottom opening such that one of said tabs is received in said narrow top opening and each of said cylindrical elements is able to roll relative to a different one of said ears.

12. An adjustable depth-of-drive assembly for use with a fastener-driving tool, said assembly comprising:

a workpiece contact element having a contact end and an adjustment end having at least one toothed edge;

a stop configured for being removably engageable with said workpiece contact element and having a depending skirt with at least one toothed surface configured for releasably engaging said at least one toothed edge;

a biasing element configured for exerting a biasing force against said stop for urging said stop into engagement with said workpiece contact element;

a spacer having a flange configured for compressing said biasing element against said stop; and at least one camming element carried on said stop for selective camming engagement against said stop by means of a user's manual force to urge said stop away from engaging contact with said workpiece contact element against said force of said biasing element.

13. The assembly of claim 12 further comprising at least two ears located on said stop, and extending outwardly from said stop, wherein said at least one camming element comprises two cylindrical elements, each with a passage therethrough sized to receive a tab depending from one of said ears of said stop.

14. The assembly of claim 13 further including a pair of opposed protrusions formed on each tab to frictionally engage opposite end walls of one of said passages.

15. The assembly of claim 13 wherein said passages each have a narrow top opening and a wide bottom opening such that one of said tabs is received in said top opening and each of said cylindrical elements is able to roll relative to a different one of said ears.

16. An adjustable depth-of-drive assembly kit for use with a fastener-driving tool, comprising:

a workpiece contact element having a contact end and an adjustment end;

a stop configured to be removably secured to said workpiece contact element and having a pair of ears, each ear being located on an opposite side of said stop from each other;

a biasing element configured to be placed on a top side of said stop;

a spacer positioned above said biasing element to press said biasing element against said stop with a biasing force;

at least one camming element carried on said stop for selective camming engagement against a lower surface of said stop by means of a user's manual force to urge said stop away from engagement with said workpiece contact element against said biasing force of said biasing element.

17. The assembly of claim 16 wherein said at least one camming element comprises two cylindrical elements, each with a passage therethrough sized to receive a tab depending from a respective one of said ears of said stop.

18. The assembly of claim 16 further including a pair of opposed protrusions formed on each tab to frictionally engage opposite end walls of one of said passages.

19. The assembly of claim 16 wherein said passages each have a narrow top opening and a wide bottom opening such that one of said tabs is received in said top opening and each of said cylindrical elements is able to roll relative to a different one of said ears.

* * * * *